US008616095B2

(12) United States Patent
Chi

(10) Patent No.: US 8,616,095 B2
(45) Date of Patent: Dec. 31, 2013

(54) RATCHET HAND TOOL WITHOUT USE OF SWITCHING MEMBER

(76) Inventor: Yuan-Chin Chi, Ta-Li (TW)

( * ) Notice: Subject to any disclaimer, the term of this patent is extended or adjusted under 35 U.S.C. 154(b) by 458 days.

(21) Appl. No.: 12/610,041

(22) Filed: Oct. 30, 2009

(65) Prior Publication Data

US 2010/0251860 A1 Oct. 7, 2010

(30) Foreign Application Priority Data

Apr. 3, 2009 (TW) ..... 98111248 A

(51) Int. Cl.
*B25B 13/00* (2006.01)
*B25B 13/46* (2006.01)

(52) U.S. Cl.
USPC ..... 81/63.2; 81/58.5; 81/61; 81/62; 81/63; 81/63.1

(58) Field of Classification Search
USPC ..... 81/61–63.2, 177.9, 58.5
See application file for complete search history.

(56) References Cited

U.S. PATENT DOCUMENTS

| | | | | |
|---|---|---|---|---|
| 2,508,604 | A * | 5/1950 | Greer et al. | 81/58.2 |
| 2,712,258 | A * | 7/1955 | Keith | 81/63 |
| 7,765,896 | B1 * | 8/2010 | Chen | 81/58.5 |
| 7,823,484 | B1 * | 11/2010 | Chen | 81/63 |
| 2002/0170393 | A1 * | 11/2002 | Yuan-Chin et al. | 81/58.5 |
| 2011/0162488 | A1 * | 7/2011 | Chan | 81/63 |

* cited by examiner

*Primary Examiner* — Bryan R Muller

(57) ABSTRACT

A hand tool includes a head in which a driving member is received and a pawl is engaged with the driving member. A handle has a substantially round driving end which is rotatably received in a pivoting recess in the head and a pushing member protrudes from the driving end and is engaged with the pawl. The handle includes two contact sides which alternatively contact two outward tapered sidewalls of a driving recess in the driving end when operating the handle. The pawl is shifted to contact the driving member by the teeth at different positions of the pawl when operating the handle to change the driving direction of the driving member. No switching member is connected to the pawl and protrudes from the top surface of the head of the hand tool.

4 Claims, 4 Drawing Sheets

RATCHET HAND TOOL WITHOUT USE OF SWITCHING MEMBER

FIELD OF THE INVENTION

The present invention relates to a ratchet hand tool without use of switching member when changing driving direction.

BACKGROUND OF THE INVENTION

A conventional ratchet hand tool such as a ratchet wrench is shown in FIG. 1, and generally includes a head 8 having a through hole 80 defined therethrough so as to receive a driving member 9 in the through hole 80. A recess is defined in an inner periphery of the through hole 10 and a pawl 96 is received in the recess. A switching member 100 is connected to the pawl 96 and has a lever which is protrudes from a top surface of the head 8. A top hole 81 is defined in the top of the head 8 and the driving member 9 has a neck portion 95 which is rotatably engaged with the top hole 81 and a bottom plate 94 is fixed to an underside of the head 8 to position the driving member 9 in the through hole 80. The driving member 9 includes a driving portion 91 which extends through the bottom plate 94 and a releasing assembly is located in the driving member for quickly releasing the driving member 9 from an object or a socket (not shown). A recess 98 is defined in an inside of the recess and a pushing unit 6 is received in the recess 98, wherein the pushing unit 6 includes a pushing piece and a spring which pushes the pushing piece to contact the pawl 96.

The user switches the lever of the switching member 100 to engage the teeth 97 on either of two separated positions of the pawl 96 with the teeth 93 of the driving member 9 so that when rotating the handle of the hand tool, the driving portion 91 of the driving member 9 outputs a torque to the object (not shown) engaged with the socket or the object mentioned above.

The lever of the switching member 100 protrudes above the top surface of the head 8 and makes the head 8 be heavy and occupy a larger space.

The present invention intends to provide a hand tool which does not need the switching member so that the top surface of the head is a flat surface and the thickness of the head can be minimized so as to easily insert into narrow space.

SUMMARY OF THE INVENTION

The present invention relates to a hand tool and the hand tool comprises a head having a through hole in which a driving member is received, and a communication hole is defined in an inner periphery of the through hole. A pivoting recess is defined in a top surface of the head and communicates with the communication hole and a driving recess is defined in the top surface of the head and communicates with the pivoting recess. Two positioning notches are defined in a surface defining the driving recess. The driving member includes a polygonal hole defined therethrough and first teeth are defined in an outer periphery of the driving member.

A pawl is received in the communication hole and includes second teeth defined in a front curved end thereof. The second teeth are engaged with the first teeth of the driving member. A recessed area is defined in a rear end of the pawl. A handle includes a substantially round driving end which is rotatably received in the pivoting recess of the head and a grasp portion is connected to the driving end. Two sides of the grasp portion are connected with two contact sides which are connected between the driving end and the grasp portion. The two contact sides are located in the driving recess of the head. A passage is defined axially in the driving end and a first spring and a pushing member are received in the passage. The first spring pushes the pushing member which has an end engaged with the recessed area of the pawl. A reception hole is defined in an underside of the grasp portion and a second spring and a bead are received in the reception hole. A biasing force of the second spring is larger than a biasing force of the first spring. The bead is movably engaged with one of the two positioning notches. A cover is fixed to the top surface of the head to cover the pivoting recess and the driving recess.

The primary object of the present invention is to provide a ratchet hand tool wherein no switching member protruding from the top surface of the head of the hand tool.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
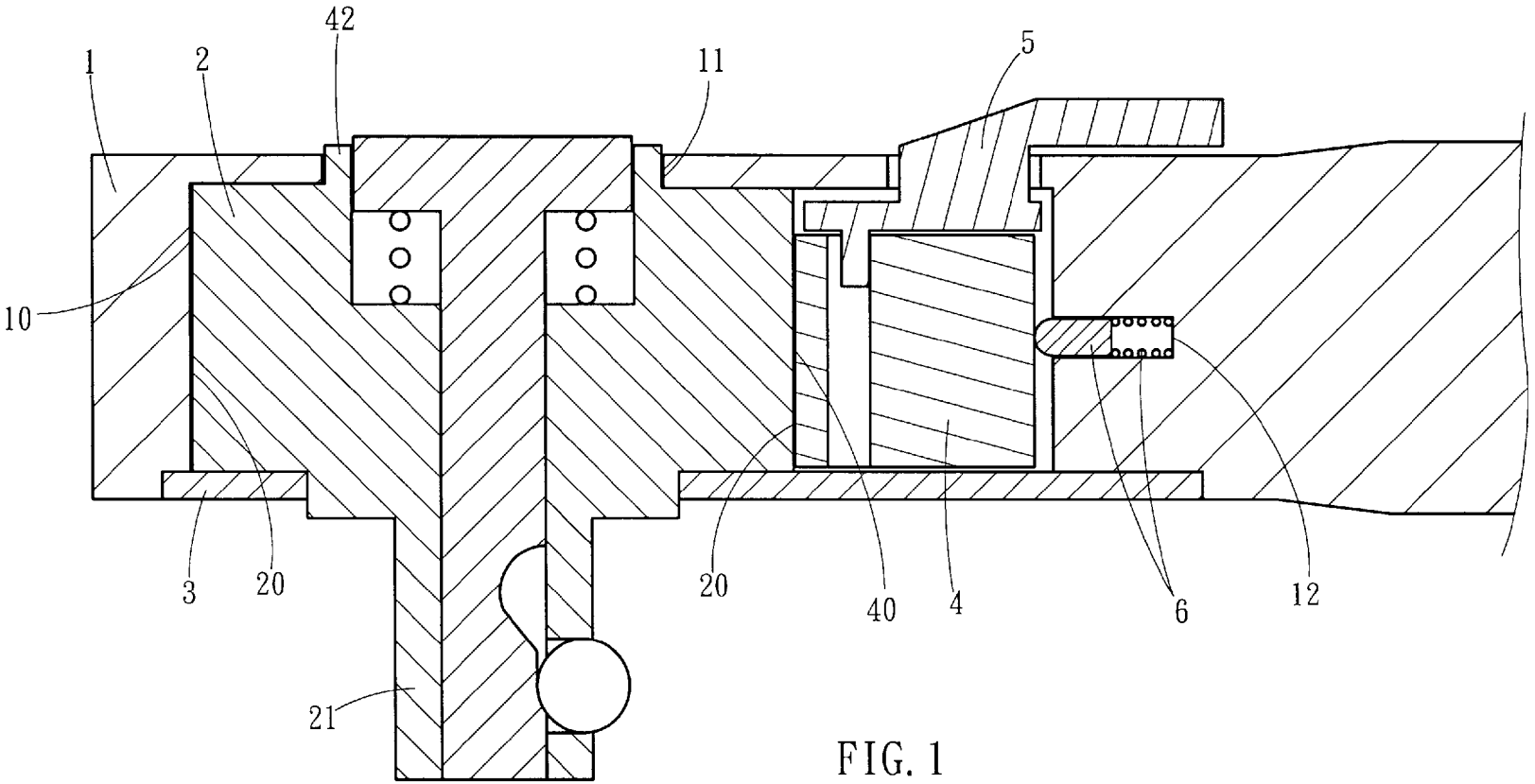
FIG. 1 shows a cross sectional view of a conventional ratchet hand tool.
Figure 2:
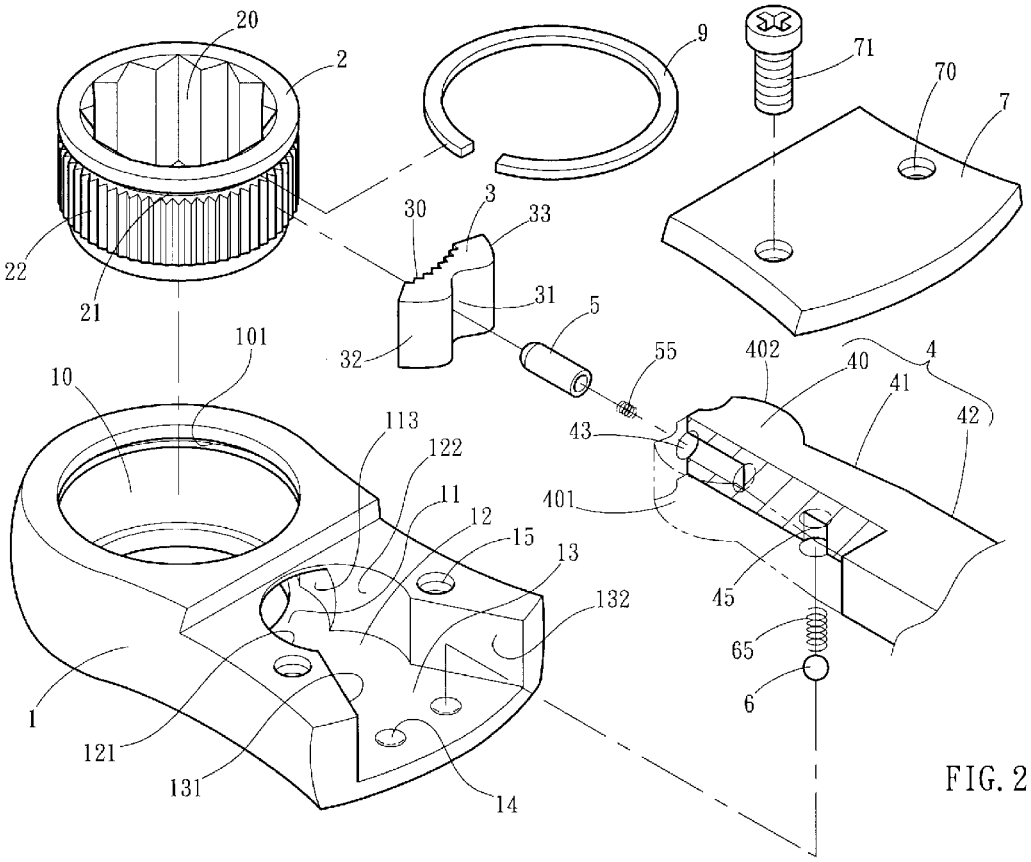
FIG. 2 is an exploded view to show the hand tool of the present invention.
Figure 3:
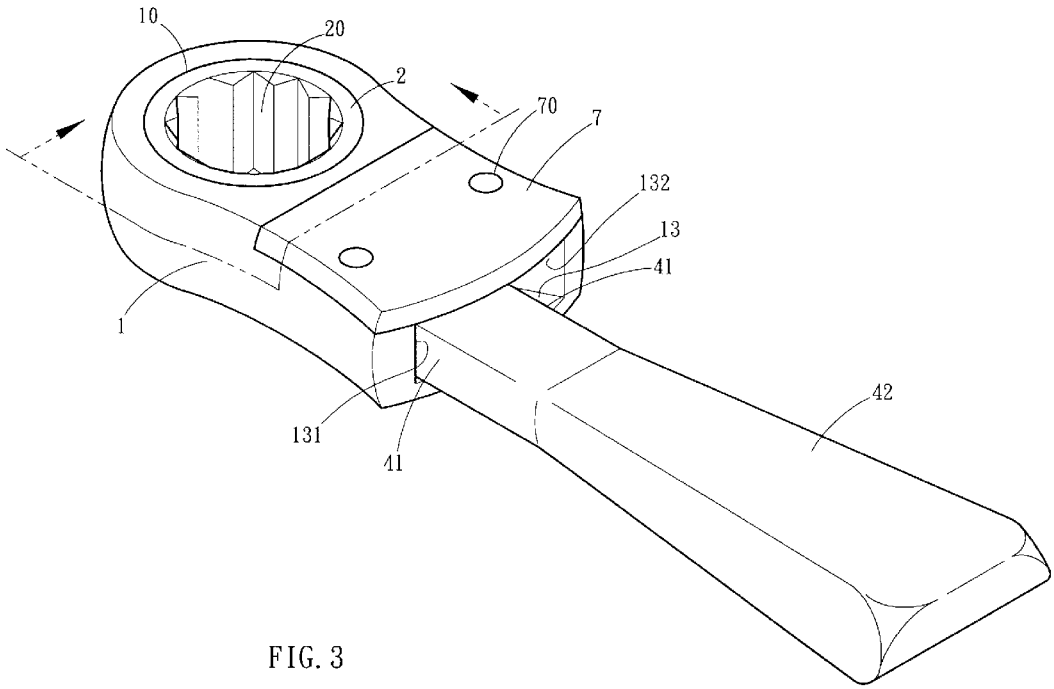
FIG. 3 is a perspective view to show the hand tool of the present invention.
Figure 4:
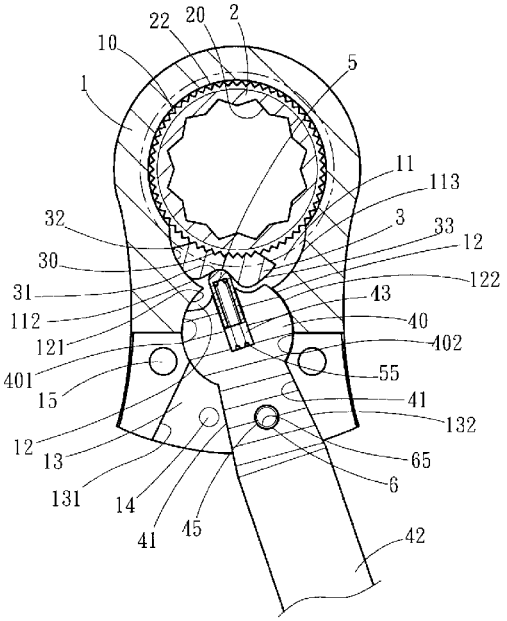
FIG. 4 is a cross sectional view to show that the head is to be rotated counter clockwise.

Referring to FIGS. 2, 3 and 4, the hand tool of the present invention comprises a head 1 having a through hole 10 defined therein and a communication hole 11 is defined in an inner periphery of the through hole 10. The communication hole 11 includes first and second curved sidewalls 112, 113. A pivoting recess 12 is defined in a top surface of the head 1 and communicates with the communication hole 11. A driving recess 13 is defined in the top surface of the head 1 and located next to the pivoting recess 12 and communicates with the pivoting recess 12. The driving recess 13 includes first and second straight walls 131, 132 which are diverted toward a direction away from the through hole 10. The pivoting recess 12 is located between the communication hole 11 and the driving recess 13. Two positioning notches 14 are defined in a surface defining the driving recess 13. The driving recess 13 is defined by two sidewalls which are tapered outward. The top surface of the head 1 has two positioning holes 15. A cover 7 has two apertures 70 and two fixing members 71 extend through the apertures 70 and are fixed to the positioning holes 15. The cover 7 is in flush with the top surface of the head 1 to cover the pivoting recess 12 and the driving recess 13. An opening is defined in an end opposite to the end having the through hole 10 and located between the cover 7 and a bottom of the head 1 so that a handle 4 connected to the head 1 extends through the opening.

A driving member 2 is rotatably received in the through hole 10 and includes a polygonal hole 20 is defined therethrough so as to be connected with an object (not shown) to be tightened or loosened of connected with a driving portion of a socket (not shown). First teeth 22 are defined in an outer periphery of the driving member 2. A first annular groove 101 is defined in an inner periphery of the through hole 10 and the driving member 2 has a second annular groove 21, a C-ring 9 is engaged with the first and second annular grooves 101, 21 to position the driving member 2 in the through hole 10.

Figure 5:
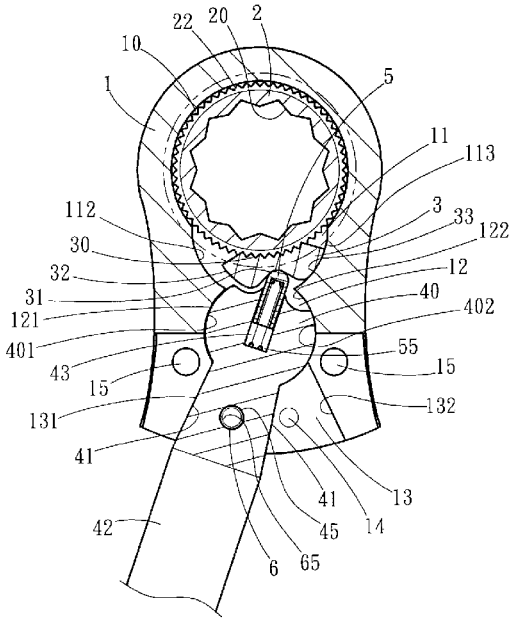
FIG. 5 is a cross sectional view to show that the head is to be rotated clockwise.

A pawl 3 is received in the communication hole 11 and has second teeth 30 defined in a front curved end thereof. The pawl 3 includes first and second end walls 32, 33 on two ends thereof and the first and second end walls 32, 33 selectively contact the first and second curved sidewalls 112, 113 of the communication hole 11 to engage the second teeth 30 of the pawl 3 with the first teeth 22 of the driving member 2. A recessed area 31 is defined in a rear end of the pawl 3. It is noted that the space of the pivoting recess 12 is sufficient for the pawl 3 to be shifted back and forth as shown in FIGS. 4 and 5.

The handle 4 has a substantially round driving end 40 which is rotatably received in the pivoting recess 12 of the head 1 and a grasp portion 42 is connected to the driving end 40. The driving end 40 has a first curved face 401 and a second curved face 402 which is located opposite to the first curved face 401. Two sides of the grasp portion 42 are connected with two contact sides 41 which are connected between the driving end 40 and the grasp portion 42. The two contact sides 41 located in the driving recess 13 of the head 1 and a distance between the two contact sides 41 is smaller than a distance between the two sidewalls of the driving recess 13, so that the handle 4 can be pivoted within the range between the two sidewalls of the driving recess 13.

A passage 43 is defined axially in the driving end 40 and a first spring 55 and a pushing member 5 are received in the passage 43. The first spring 55 pushes the pushing member 5 which has an end engaged with the recessed area 31 of the pawl 3. A reception hole 45 is defined in an underside of the grasp portion 42 and located between the two contact sides 41. The reception hole 45 is perpendicular to an axis of the handle 4. A second spring 65 and a bead 6 are received in the reception hole 45. A biasing force of the second spring 65 is larger than a combination of the biasing force of the first spring 55 and a friction force between the first teeth 22 of the driving member 2 and the second teeth 30 of the pawl 3. By this way, the handle 4 does not change its position when the pawl 3 moves.

As shown in FIG. 4, when an object (not shown) is engaged with the polygonal hole 20 of the driving member 2 and the user (not shown) rotates the handle 4 counter clockwise. The right contact side 41 (as seen in FIG. 4) contacts the second straight wall 132 of the driving recess 13 and the bead 6 is positioned with the right positioning notch 14 (as seen in FIG. 4). The first curved face 401 of the driving end 40 contacts the first curved wall 121 and the pawl 3 is pushed by the pushing member 5 and its first end wall 32 is in contact with the first curved sidewall 112 of the pivoting recess 12. The first and second teeth 22, 30 arc engaged with each other so as to force the head 1 to rotate counter clockwise to apply a torque to the object to tighten or loosen the object.

As shown in FIG. 5, when rotating the handle 4 clockwise, the first curved face 401 removed from the first curved wall 121 and the second curved face 402 contacts the second curved wall 122. The left contact side contacts the first straight wall 131. Because the biasing force of the second spring 65 is larger than the combination of the biasing force of the first spring 55 and a friction force between the first teeth 22 of the driving member 2 and the second teeth 30 of the pawl 3, the head 1 is rotated clockwise such that the first end wall 32 of the pawl 3 removes from the first curved sidewall 112 of the pivoting recess 12 and the second end wall 33 of the pawl 3 contacts the second curved sidewall 113 of the pivoting recess 12. The first spring 55 is pushed and compressed toward the handle 4 when the second teeth 30 move over the first teeth 22. The first spring 55 pushes the second teeth 30 to engage with the first teeth 22 when the pawl 3 moves to the position as shown in FIG. 5. Therefore, the user can rotate the handle back and forth.

When changing the effective rotation direction of the hand tool form the status in FIG. 4, the user holds or presses the head 1, then rotates the handle 4 about the pivoting recess 12 till the left contact side 41 contacts the first straight wall 131 of the driving recess 13, and the bead 6 is shifted to and engaged with the left positioning notch 14. The pushing member 5 pushes the pawl 3 to the right until second end wall 33 of the pawl 3 contacts the second curved sidewall 113 of the driving recess 13, and the first and second teeth 22, 30 are engaged with each other as shown in FIG. 5.

The hand tool does not have switching member protruding out from the top surface of the head 1 and includes less number of parts so that the hand tool has slim outer profile and can be manufactured at low cost.

While we have shown and described the embodiment in accordance with the present invention, it should be clear to those skilled in the art that further embodiments may be made without departing from the scope of the present invention.

What is claimed is:

1. A hand tool comprising:

a head having a through hole defined therein and a communication hole defined in an inner periphery of the through hole, the communication hole including first and second curved sidewalls, a pivoting recess defined in a top surface of the head and communicating with the communication hole, a driving recess defined in the top surface of the head and communicating with the pivoting recess, the driving recess including first and second straight walls which are diverted toward a direction away from the through hole, two positioning notches defined in a surface defining the driving recess, the pivoting recess located between the communication hole and the driving recess;

a driving member rotatably received in the through hole and including a polygonal hole defined therethrough, first teeth defined in an outer periphery of the driving member;

a pawl received in the communication hole and having second teeth defined in a front curved end thereof, the pawl including first and second end walls on two ends thereof and the first and second end walls selectively contacting the first and second curved sidewalls of the communication hole to engage the second teeth of the pawl with the first teeth of the driving member, a recessed area defined in a rear end of the pawl;

a handle having a substantially round driving end which is rotatably received in the pivoting recess of the head and a grasp portion connected to the driving end, the driving end having a first curved face and a second curved face which is located opposite to the first curved face, two sides of the grasp portion connected with two contact sides which are connected between the driving end and the grasp portion, the two contact sides located in the driving recess of the head, a passage defined axially in the driving end and a first spring and a pushing member received in the passage, the first spring pushing the pushing member which has an end engaged with the recessed area of the pawl, a reception hole defined in an underside of the grasp portion and located between the two contact sides, the reception hole being perpendicular to an axis of the handle, a second spring and a bead received in the reception hole, a biasing force of the second spring being larger than a biasing force of the first spring, the bead movably engaged with one of the two positioning notches, and a cover fixed to the top surface of the head to cover the pivoting recess and the driving recess, when the driving end is pivoted within the pivoting recess of the head, the first and second curved faces of the driving end are in contact with the first and second curved walls of the pivoting recess, the two contact sides of the grasp portion are selectively in contact with the first and second straight walls of the driving recess, the pushing member in the passage of the driving end pushes the pawl to move to selectively contact the first and second curved sidewalls of the communication hole such that the second teeth of the pawl are engaged with the first teeth of the driving member, the bead in the reception hole is selectively engaged with the positioning notches.

2. The hand tool as claimed in claim 1, wherein the top surface of the head has two positioning holes and the cover has two apertures, two fixing members extend through the apertures and are fixed to the positioning holes.

3. The hand tool as claimed in claim 1, wherein the biasing force of the second spring is larger than a combination of the biasing force of the first spring and a friction force between the first teeth of the driving member and the second teeth of the pawl.

4. The hand tool as claimed in claim 1, wherein the driving recess is defined by two sidewalls which are tapered outward and a distance between the two contact sides is smaller than a distance between the two sidewalls of the driving recess.

* * * * *